US009593642B2

(12) United States Patent
Wicks et al.

(10) Patent No.: US 9,593,642 B2
(45) Date of Patent: Mar. 14, 2017

(54) COMPOSITE CAM CARRIER

(71) Applicant: Ford Global Technologies, LLC, Dearborn, MI (US)

(72) Inventors: Christopher Donald Wicks, Allen Park, MI (US); Mark Michael Madin, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 69 days.

(21) Appl. No.: 14/576,616

(22) Filed: Dec. 19, 2014

(65) Prior Publication Data

US 2016/0177868 A1 Jun. 23, 2016

(51) Int. Cl.

| | |
|---|---|
| ***F01L 1/46*** | (2006.01) |
| ***F02F 7/00*** | (2006.01) |
| ***F01L 1/053*** | (2006.01) |
| *F01L 1/047* | (2006.01) |
| *F01M 9/10* | (2006.01) |
| *F02F 11/00* | (2006.01) |

(52) U.S. Cl.

CPC ..... *F02F 7/006* (2013.01); *F01L 1/0532* (2013.01); *F02F 7/0085* (2013.01); *F01L 2001/0471* (2013.01); *F01L 2001/0476* (2013.01); *F01L 2001/0537* (2013.01); *F01L 2101/00* (2013.01); *F01L 2103/00* (2013.01); *F01L 2810/02* (2013.01); *F01M 9/102* (2013.01); *F02F 11/002* (2013.01)

(58) Field of Classification Search

CPC ..... F01L 1/0532; F01L 2001/0476; F01L 2101/00; F01L 2103/00; F01M 9/102; F02F 7/006; F02F 7/0085; F02F 11/002

USPC ..... 123/90.17, 90.27, 90.34, 90.37, 90.38, 123/90.6

See application file for complete search history.

(56) References Cited

U.S. PATENT DOCUMENTS

| | | | |
|---|---|---|---|
| 2,958,369 | A | 11/1960 | Pitts et al. |
| 3,403,938 | A | 10/1968 | Cramer et al. |
| 3,929,374 | A | 12/1975 | Hogan et al. |

(Continued)

FOREIGN PATENT DOCUMENTS

| | | | |
|---|---|---|---|
| CN | 201650491 | U | 11/2010 |
| CN | 203097995 | U | 7/2013 |

(Continued)

OTHER PUBLICATIONS

M. Grujicic et al., "Seat-cushion and soft-tissue material modeling and a finite element investigation of the seating comfort for passenger-vehicle occupants," Materials and Design 30 (2009) 4273-4285.

(Continued)

*Primary Examiner* — Jorge Leon, Jr.
(74) *Attorney, Agent, or Firm* — Greg P. Brown

(57) ABSTRACT

A cam carrier assembly includes a cylinder head having valves and a camshaft having lobes. A cam carrier has a first side coupled with the cylinder head engaging around the valves and a second side with bearing surfaces supporting the camshaft. A series of apertures extend between the first and second sides for the lobes to interface with the valves. The cam carrier is made of carbon fiber composite insulating the camshaft from the cylinder head and providing substantial weight reduction to an upper section of an associated engine.

17 Claims, 10 Drawing Sheets

(56) References Cited

U.S. PATENT DOCUMENTS 4,324,431 A 4/1982 Murphy et al.
4,334,709 A 6/1982 Akiyama et al.
4,353,595 A 10/1982 Kaneko et al.
4,541,669 A 9/1985 Goldner
4,629,248 A 12/1986 Mawbey
4,720,141 A 1/1988 Sakamoto et al.
4,915,447 A 4/1990 Shovar
5,171,062 A 12/1992 Courtois
5,174,526 A 12/1992 Kanigowski
5,285,754 A 2/1994 Bell
5,323,740 A 6/1994 Daily et al.
5,375,569 A 12/1994 Santella
5,518,294 A 5/1996 Ligon, Sr. et al.
5,540,553 A * 7/1996 Goto ..... B29C 45/0005 416/241 A
5,560,681 A 10/1996 Dixon et al.
5,647,635 A 7/1997 Aumond et al.
5,755,493 A 5/1998 Kodaverdian
5,769,489 A 6/1998 Dellanno
5,826,938 A 10/1998 Yanase et al.
5,836,648 A 11/1998 Karschin et al.
5,902,014 A 5/1999 Dinkel et al.
5,913,568 A 6/1999 Brightbill et al.
5,951,039 A 9/1999 Severinski et al.
6,024,406 A 2/2000 Charras et al.
6,062,642 A 5/2000 Sinnhuber et al.
6,145,925 A 11/2000 Eksin et al.
6,155,593 A 12/2000 Kimura et al.
6,179,379 B1 1/2001 Andersson
6,189,966 B1 2/2001 Faust et al.
6,196,627 B1 3/2001 Faust et al.
6,206,466 B1 3/2001 Komatsu
6,217,062 B1 4/2001 Breyvogel et al.
6,220,661 B1 4/2001 Peterson
6,224,150 B1 5/2001 Eksin et al.
6,296,308 B1 10/2001 Cosentino et al.
6,312,050 B1 11/2001 Eklind
6,364,414 B1 4/2002 Specht
6,375,269 B1 4/2002 Maeda et al.
6,394,546 B1 5/2002 Knoblock et al.
6,454,353 B1 9/2002 Knaus
6,523,892 B1 2/2003 Kage et al.
6,550,856 B1 4/2003 Ganser et al.
6,565,150 B2 5/2003 Fischer et al.
6,619,605 B2 9/2003 Lambert
6,682,140 B2 1/2004 Minuth et al.
6,695,406 B2 2/2004 Plant
6,698,832 B2 3/2004 Boudinot
6,736,452 B2 5/2004 Aoki et al.
6,758,522 B2 7/2004 Ligon, Sr. et al.
6,808,230 B2 10/2004 Buss et al.
6,824,212 B2 11/2004 Malsch et al.
6,848,742 B1 2/2005 Aoki et al.
6,860,559 B2 3/2005 Schuster, Sr. et al.
6,860,564 B2 3/2005 Reed et al.
6,866,339 B2 3/2005 Itoh
6,869,140 B2 3/2005 White et al.
6,890,029 B2 5/2005 Svantesson
6,938,953 B2 9/2005 Håland et al.
6,955,399 B2 10/2005 Hong
6,962,392 B2 11/2005 O'Connor
6,988,770 B2 1/2006 Witchie
6,997,473 B2 2/2006 Tanase et al.
7,040,699 B2 5/2006 Curran et al.
7,100,992 B2 9/2006 Bargheer et al.
7,131,694 B1 11/2006 Buffa
7,159,934 B2 1/2007 Farquhar et al.
7,185,950 B2 3/2007 Pettersson et al.
7,213,876 B2 5/2007 Stoewe
7,229,118 B2 6/2007 Saberan et al.
7,261,371 B2 8/2007 Thunissen et al.
7,316,215 B1 1/2008 Nino et al.
7,344,189 B2 3/2008 Reed et al.
7,350,859 B2 4/2008 Klukowski
7,393,005 B2 7/2008 Inazu et al.
7,425,034 B2 9/2008 Bajic et al.
7,441,838 B2 10/2008 Patwardhan
7,467,823 B2 12/2008 Hartwich
7,478,869 B2 1/2009 Lazanja et al.
7,481,489 B2 1/2009 Demick
7,506,924 B2 3/2009 Bargheer et al.
7,506,938 B2 3/2009 Brennan et al.
7,530,633 B2 5/2009 Yokota et al.
7,543,888 B2 6/2009 Kuno
7,578,552 B2 8/2009 Bajic et al.
7,597,398 B2 10/2009 Lindsay
7,614,693 B2 11/2009 Ito
7,641,281 B2 1/2010 Grimm
7,669,925 B2 3/2010 Beck et al.
7,669,928 B2 3/2010 Snyder
7,712,833 B2 5/2010 Ueda
7,717,459 B2 5/2010 Bostrom et al.
7,726,733 B2 6/2010 Balser et al.
7,735,932 B2 6/2010 Lazanja et al.
7,752,720 B2 7/2010 Smith
7,753,451 B2 7/2010 Maebert et al.
7,775,602 B2 8/2010 Lazanja et al.
7,784,863 B2 8/2010 Fallen
7,802,843 B2 9/2010 Andersson et al.
7,819,470 B2 10/2010 Humer et al.
7,823,971 B2 11/2010 Humer et al.
7,845,729 B2 12/2010 Yamada et al.
7,857,381 B2 12/2010 Humer et al.
7,871,126 B2 1/2011 Becker et al.
7,891,701 B2 2/2011 Tracht et al.
7,909,360 B2 3/2011 Marriott et al.
7,931,294 B2 4/2011 Okada et al.
7,931,330 B2 4/2011 Itou et al.
7,946,649 B2 5/2011 Galbreath et al.
7,963,553 B2 6/2011 Huynh et al.
7,963,595 B2 6/2011 Ito et al.
7,963,600 B2 6/2011 Alexander et al.
7,971,931 B2 7/2011 Lazanja et al.
7,971,937 B2 7/2011 Ishii et al.
8,011,726 B2 9/2011 Omori et al.
8,016,355 B2 9/2011 Ito et al.
8,029,055 B2 10/2011 Hartlaub
8,038,222 B2 10/2011 Lein et al.
8,075,053 B2 12/2011 Tracht et al.
8,109,569 B2 2/2012 Mitchell
8,123,246 B2 2/2012 Gilbert et al.
8,128,167 B2 3/2012 Zhong et al.
8,162,391 B2 4/2012 Lazanja et al.
8,162,397 B2 4/2012 Booth et al.
8,167,370 B2 5/2012 Arakawa et al.
8,210,568 B2 7/2012 Ryden et al.
8,210,605 B2 7/2012 Hough et al.
8,210,611 B2 7/2012 Aldrich et al.
8,226,165 B2 7/2012 Mizoi
8,342,607 B2 1/2013 Hofmann et al.
8,397,688 B2 3/2013 Cunningham
2004/0144349 A1 7/2004 Wampula et al.
2004/0195870 A1 10/2004 Bohlender et al.
2005/0200166 A1 9/2005 Noh
2005/0252470 A1* 11/2005 Malek ..... F01L 1/053 123/90.27
2006/0043777 A1 3/2006 Friedman et al.
2007/0120401 A1 5/2007 Minuth et al.
2007/0240671 A1* 10/2007 Imazato ..... F01L 1/053 123/193.5
2008/0173273 A1* 7/2008 Cunningham ..... F02F 7/006 123/195 C
2008/0174159 A1 7/2008 Kojima et al.
2009/0066122 A1 3/2009 Minuth et al.
2009/0165263 A1 7/2009 Smith
2009/0322124 A1 12/2009 Barkow et al.
2010/0038937 A1 2/2010 Andersson et al.
2010/0140986 A1 6/2010 Sawada
2010/0171346 A1 7/2010 Laframboise et al.
2010/0187881 A1 7/2010 Fujita et al.
2010/0201167 A1 8/2010 Wieclawski
2010/0231013 A1 9/2010 Schlenker
2010/0270840 A1 10/2010 Tanaka et al.
2010/0301650 A1 12/2010 Hong

(56) References Cited

U.S. PATENT DOCUMENTS

| | | | |
|---|---|---|---|
| 2010/0320816 | A1 | 12/2010 | Michalak |
| 2011/0018498 | A1 | 1/2011 | Soar |
| 2011/0074185 | A1 | 3/2011 | Nakaya et al. |
| 2011/0095513 | A1 | 4/2011 | Tracht et al. |
| 2011/0095578 | A1 | 4/2011 | Festag |
| 2011/0109127 | A1 | 5/2011 | Park et al. |
| 2011/0109128 | A1 | 5/2011 | Axakov et al. |
| 2011/0121624 | A1 | 5/2011 | Brncick et al. |
| 2011/0133525 | A1 | 6/2011 | Oota |
| 2011/0155084 | A1 | 6/2011 | Sargeant |
| 2011/0163574 | A1 | 7/2011 | Tame et al. |
| 2011/0163583 | A1 | 7/2011 | Zhong et al. |
| 2011/0186560 | A1 | 8/2011 | Kennedy et al. |
| 2011/0187174 | A1 | 8/2011 | Tscherbner |
| 2011/0254335 | A1 | 10/2011 | Pradier et al. |
| 2011/0260506 | A1 | 10/2011 | Kuno |
| 2011/0272548 | A1 | 11/2011 | Rudkowski et al. |
| 2011/0272978 | A1 | 11/2011 | Nitsuma |
| 2011/0278885 | A1 | 11/2011 | Procter et al. |
| 2011/0278886 | A1 | 11/2011 | Nitsuma |
| 2011/0298261 | A1 | 12/2011 | Holt et al. |
| 2012/0032486 | A1 | 2/2012 | Baker et al. |
| 2012/0037754 | A1 | 2/2012 | Kladde |
| 2012/0063081 | A1 | 3/2012 | Grunwald |
| 2012/0080914 | A1 | 4/2012 | Wang |
| 2012/0091695 | A1 | 4/2012 | Richez et al. |
| 2012/0091766 | A1 | 4/2012 | Yamaki et al. |
| 2012/0091779 | A1 | 4/2012 | Chang et al. |
| 2012/0109468 | A1 | 5/2012 | Baumann et al. |
| 2012/0119551 | A1 | 5/2012 | Brncick et al. |
| 2012/0125959 | A1 | 5/2012 | Kucera |
| 2012/0127643 | A1 | 5/2012 | Mitchell |
| 2012/0129440 | A1 | 5/2012 | Kitaguchi et al. |
| 2012/0162891 | A1 | 6/2012 | Tranchina et al. |
| 2012/0167845 | A1 | 7/2012 | Sands et al. |
| 2012/0175924 | A1 | 7/2012 | Festag et al. |
| 2012/0187729 | A1 | 7/2012 | Fukawatase et al. |
| 2012/0248833 | A1 | 10/2012 | Hontz et al. |
| 2012/0261974 | A1 | 10/2012 | Yoshizawa et al. |
| 2013/0076092 | A1 | 3/2013 | Kulkarni et al. |

FOREIGN PATENT DOCUMENTS

| | | |
|---|---|---|
| EP | 0754590 | 1/1997 |
| EP | 0926969 | 1/2002 |
| EP | 1266794 | 3/2004 |
| EP | 1123834 | 10/2004 |
| EP | 1050429 | 10/2005 |
| EP | 1084901 | 6/2006 |
| EP | 1674333 | 8/2007 |
| EP | 1950085 | 12/2008 |
| EP | 1329356 | 11/2009 |
| JP | 201178557 A | 4/2011 |
| WO | WO9511818 | 5/1995 |
| WO | WO9958022 | 11/1999 |
| WO | WO2006131189 | 12/2006 |
| WO | WO2007028015 | 8/2007 |
| WO | 2008019981 A1 | 2/2008 |
| WO | WO2008073285 | 6/2008 |
| WO | WO2011021952 | 2/2011 |
| WO | WO2012008904 | 1/2012 |

OTHER PUBLICATIONS

"Thigh Support for Tall Drivers," http://cars.about.com/od/infiniti/ig/2009-Infiniti-G37-Coupe-pics/2008-G37-cpe-thigh-support.htm (1 page).

Mladenov, "Opel Insignia Receives Seal of Approval for Ergonomic Seats," Published Aug. 27, 2008, http://www.automobilesreview.com/auto-news/opel-insignia-receives-seal-of-approval-for-ergonomic-seats/4169/ (2 pages).

Brose India Automotive Systems, "Adaptive Sensor Controlled Headrest," http://www.indiamart.com/broseindiaautomotivesystems/products.html, Oct. 9, 2012 (12 pages).

ecoustics.com, "Cineak Motorized Articulating Headrest Preview," http://www.ecoustics.com/ah/reviews/furniture/accessories/cineak-motorized-headrest, Oct. 9, 2012 (3 pages).

"'Performance' Car Seat Eliminates Steel," Published in Plastics News—Indian Edition Plastics & Polymer News, (http://www.plasticsinfomart.com/performance-car-seat-eliminates-steel/), Jan. 2012, 3 pages.

"Frankfurt 2009 Trend—Light and Layered." by Hannah Macmurray, Published in GreenCarDesign, (http://www.greencardesign.com/site/trends/00138-frankfurt-2009-trend-light-and-layered), Sep. 2009, 9 pages.

"Imola Pro-fit", Cobra, (http://cobra.subesports.com/products/cat/seats/brand/Cobra/prodID/656), Date unknown, 2 pages.

* cited by examiner

COMPOSITE CAM CARRIER

STATEMENT REGARDING FEDERALLY SPONSORED RESEARCH AND DEVELOPMENT

This invention was made with government support under Award No. DE-EE0005574, awarded by the U.S. Department of Energy. The government has certain rights in the invention.

FIELD OF THE INVENTION

The present invention generally relates to a cam carrier assembly that supports a camshaft to interface with engine valves, and more particularly relates to a cam carrier made of a carbon fiber composite and an associated assembly method.

BACKGROUND OF THE INVENTION

It is generally understood that internal combustion engines have intake and exhaust valves that typically interface directly or indirectly with cam lobes of a camshaft to control timing of the valves opening and closing. The camshaft is commonly attached to a cylinder head with metal parts that form a cam carrier and is then enclosed with a separate cam cover. It is generally appreciated that reduced weight of a vehicle is desired for increased fuel efficiency, among other reasons. Previous attempts to reduce engine weight have included forming the cam cover with polymeric materials and lightweight metals.

SUMMARY OF THE INVENTION

According to one aspect of the present invention, a cam carrier assembly includes a camshaft having lobes and a cam carrier. The cam carrier is made entirely of carbon fiber composite. The cam carrier also has a lower side for engaging a cylinder head, an upper side with semi-circular bearing surfaces supporting the camshaft, and a linear series of apertures extending between the upper and lower sides in alignment with the camshaft for the lobes to interface with valves on the cylinder head.

According to another aspect of the present invention, a cam carrier includes a single piece of carbon fiber composite that has a first side for engaging a cylinder head. The single piece of carbon fiber composite also has an opposing second side with bearing surfaces for supporting a camshaft. A series of apertures extend between the first and second sides in linear alignment with the bearing surfaces for the camshaft to interface with valves on the cylinder head.

According to yet another aspect of the present invention, a cam carrier assembly includes a cylinder head having valves and a camshaft having lobes. A cam carrier has a first side coupled with the cylinder head engaging around the valves and a second side with bearing surfaces supporting the camshaft. A series of apertures extend between the first and second sides for the lobes to interface with the valves. The cam carrier is made of carbon fiber composite insulating the camshaft from the cylinder head.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
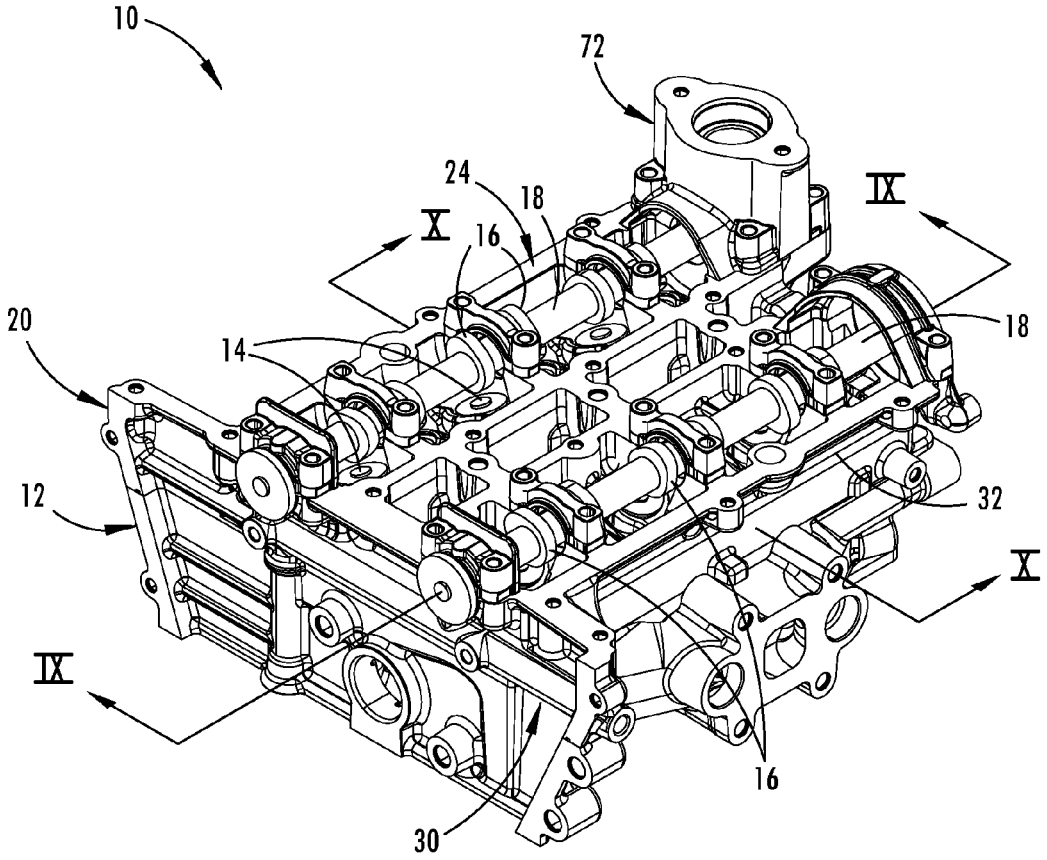
FIG. 1 is a top perspective view of a cam carrier assembly having a cam carrier attached to a cylinder head, according to one embodiment of the present invention.

For purposes of description herein, the terms "upper," "lower," "right," "left," "rear," "front," "vertical," "horizontal," and derivatives thereof shall relate to the embodiment of the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1-12, reference numeral 10 generally designates a cam carrier assembly that includes a cylinder head 12 having a series of engine valves 14 that interface with a plurality of cam lobes 16 of a camshaft 18. A cam carrier 20 of the cam carrier assembly 10 includes a first side 22 coupled with the cylinder head 12 in sealed engagement around the valves 14. A second side 24 of the cam carrier 20 has semi-circular bearing surfaces 26 that support the camshaft 18. A series of apertures 28 extend between the first and second sides 22, 24 of the cam carrier 20 for the plurality of cam lobes 16 of the camshaft 18 to interface with the series of engine valves 14 and operate the associated engine in according with the overall engine requirements for a vehicle. It is however, contemplated that the carrier assembly 10 may also be applied to engines not used in conjunction with a vehicle. The cam carrier 20 of the present invention is made of carbon fiber composite. The carbon fiber composite may be configured to insulate the camshaft 18 from the cylinder head 12 and provide a substantial weight reduction to an upper section of an associated engine, lowering the vehicle center of gravity among other advantages over metals typically used for cam carriers.

Referring now to the embodiment illustrated in FIG. 1, the cam carrier assembly 10 is shown with the cam carrier 20 attached to an upper portion 30 of the cylinder head 12 for enclosing the engine valves 14 and positioning the camshaft 18 and associated cam lobes 16 in alignment to interface with the engine valves 14. It is contemplated that the upper portion 30 of the cylinder head 12 may include rocker arms, intake and exhaust valves, valve springs, and other conceivable components that may be concealed by the cam carrier 20. Although referenced herein as the upper portion 30 of the cylinder head 12, it is understood that additional embodiments of the cylinder head 12 may be alternatively oriented or rotated, such as in a boxer-style engine, to position the valves on a lower or side portion of the cylinder head 12.

As also shown in the embodiment depicted in FIG. 1, a lower peripheral edge 32 of the first side 22 (FIG. 2) of the cam carrier 20 is generally fixedly attached around the upper portion 30 of the cylinder head 12 to form a liquid seal for preventing fluid from leaking there between. In one embodiment, the liquid seal may be formed by a gasket 34 (FIG. 9) attached around the peripheral edge 32 and compressed between the cylinder head 12 and the cam carrier 20. It is also contemplated that the liquid seal may be formed by other materials, such as liquid gaskets, that may be disposed there between to provide a seal that prevents liquid and gases from escaping.

Figure 2:
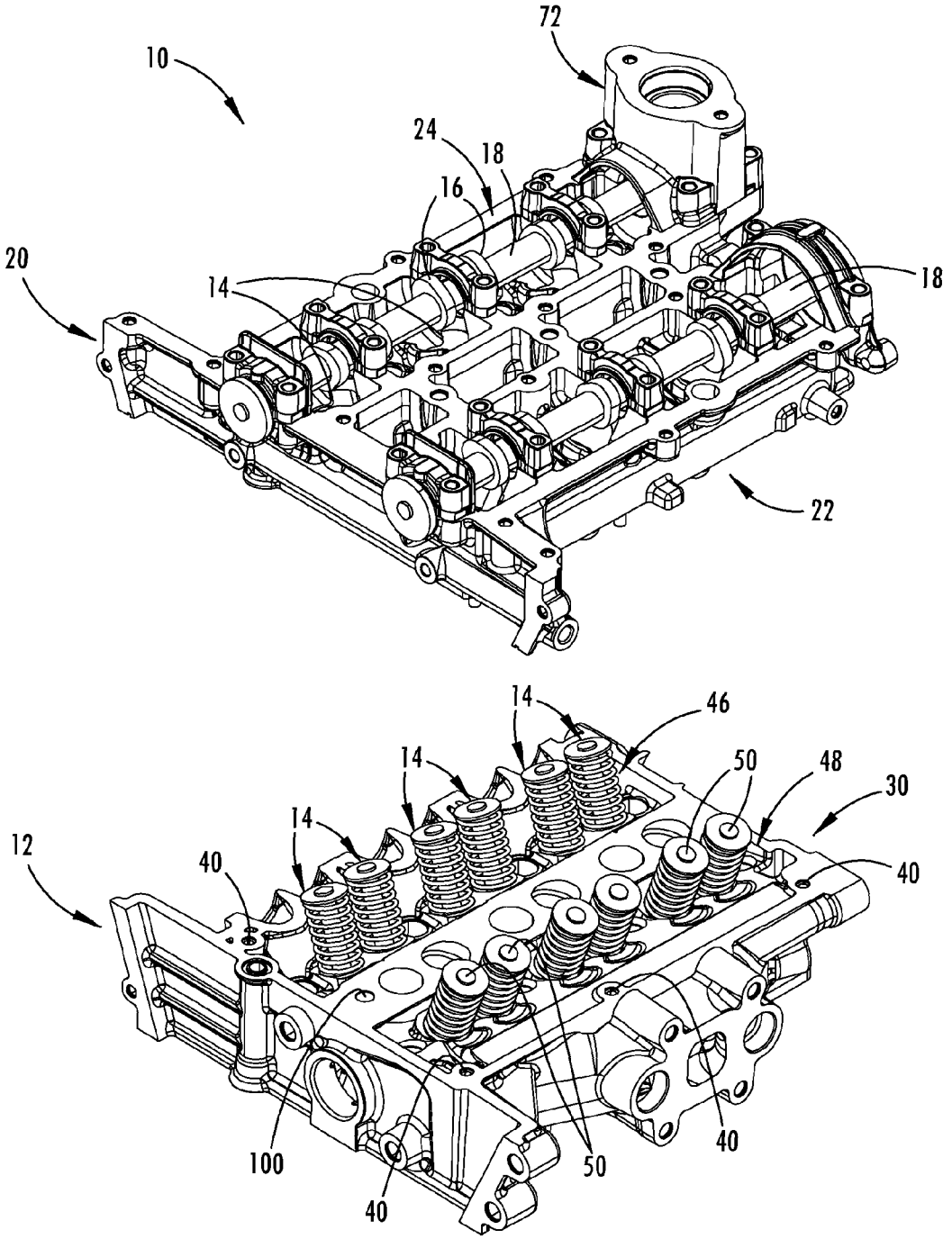
FIG. 2 is an exploded top perspective view of the cam carrier assembly shown in FIG. 1, illustrating the cam carrier exploded away from the cylinder head.

With reference to FIG. 2, the illustrated embodiment of the cam carrier 20 also includes mounting holes 36 (FIG. 4) inward from the peripheral edge 32 extending between the first and second sides 22, 24 to allow threaded fasteners 38 (FIG. 10) to extend through the cam carrier 20 and into threaded engagement with corresponding fastening holes 40 on the cylinder head 12, thereby securing the cam carrier 10 to the cylinder head 12. The mounting holes 36 are aligned with the fastening holes 40 to allow cylindrically shaped shanks 42 of the threaded fasteners 38 (FIG. 10) to pass through the mounting holes 36 and engage the threaded fastening holes 40. The material of the cam carrier 20 surrounding the mounting holes 36 is sized with sufficient mass to allow the a head portion 44 of the threaded fasteners 38 (FIG. 10) to abut and compress the cam carrier 20 proximate the mounting holes 36 and form the fluid seal between the cam carrier 20 and the cylinder head 12. In additional embodiments, it is appreciated that the mounting holes 36 may be alternatively shaped and arranged on the cam carrier 10, such as outside the gasket 34 along the peripheral edge 32. It is also contemplated that the threaded fasteners 38 may include bolts, screws, or other conceivable fasteners or attachment features that will withstand operating conditions of the engine.

As further illustrated in FIG. 2, the cam carrier 20 is detached from the cylinder head 12 to also expose the engine valves 14 on the upper portion 30 of the cylinder head 12. The illustrated embodiment of the cylinder head 12 includes an intake row 46 and an exhaust row 48 of the engine valves 14, whereby each piston cylinder has two valves from the intake row 46 and two valves from the exhaust row 48. It is conceivable that in an additional embodiment, there may be more or fewer valves 14 on the cylinder head 12 and the valves 14 may be alternatively arranged, configured, and otherwise dedicated to piston cylinders from that of the illustrated embodiment. The valves 14 on the illustrated cylinder head 12 are aligned with the linear series of apertures 28 (FIG. 6) extending between the upper and lower sides 24, 22 of the cam carrier 20 for the lobes 16 of the camshaft 18 to interface with valves 14 on the cylinder head 12. Specifically, the illustrated embodiment has two camshafts 18, one camshaft 18 for each row 46, 48 of valves 14 with a lobe 16 on the camshafts 18 for each valve 14. Accordingly, the valves 14 extend upward in the apertures 28 in the cam carrier 20 and are provided with distal end surfaces 50 that directly abut the lobes 16 of the camshaft 18. It is conceivable that in the valves 14 may have rolling end surfaces or bucket tappets, and in additional embodiments the valves 14 may be attached to rocker arms or otherwise configured to interface with the lobes 16 of the camshaft 18.

Figure 3:
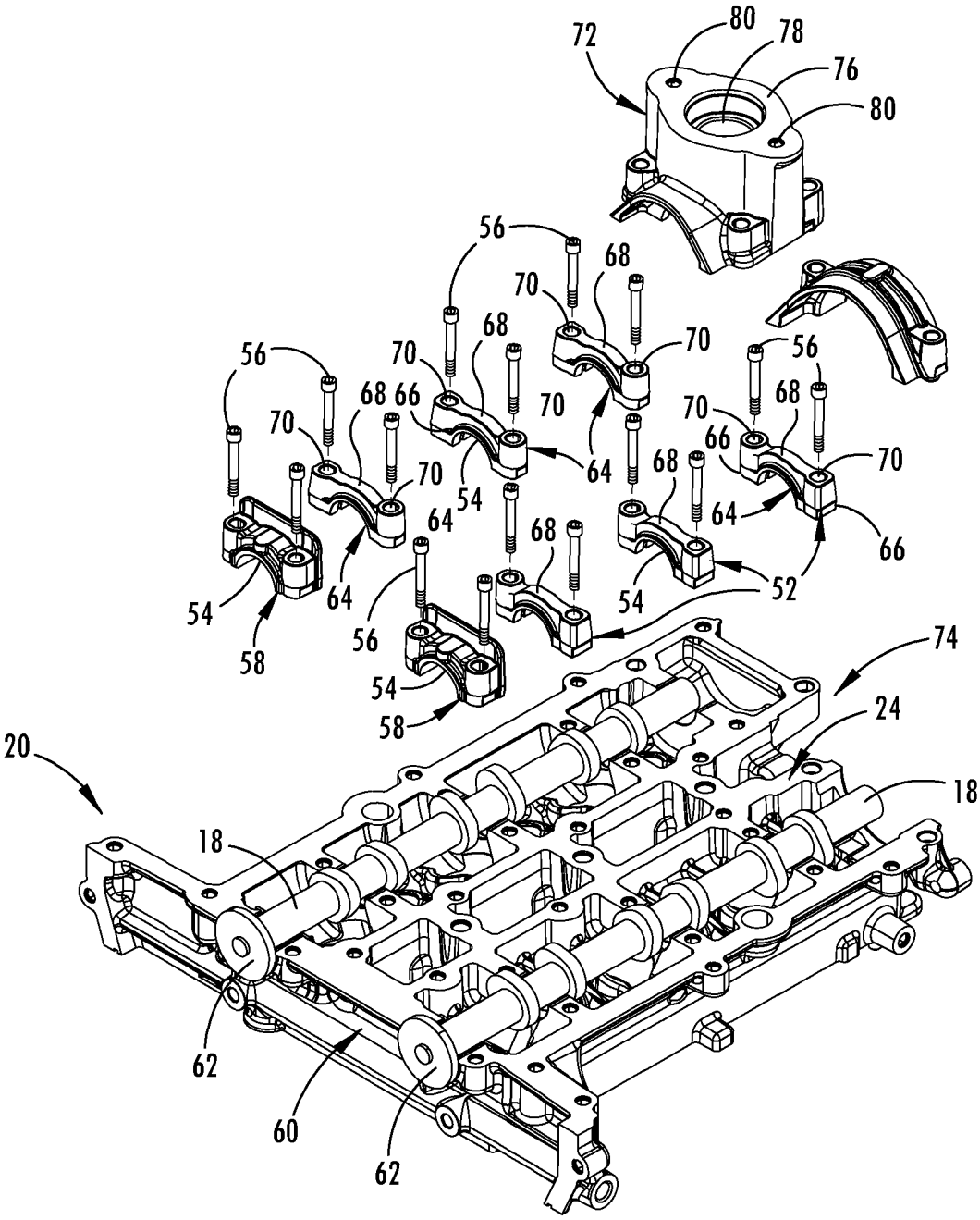
FIG. 3 is an exploded top perspective view of the cam carrier assembly shown in FIG. 1, illustrating cam caps and a fuel pump pedestal exploded away from the cam carrier.

Referring now to FIG. 3, the cam carrier 20 is illustrated separate from the cylinder head 12 (FIG. 2) with a plurality of cam caps 52 exploded away from the upper side 24 of the cam carrier 20, each having a semi-circular bearing surface 54 for directly engaging the camshaft 18 and supporting rotation thereof. The plurality of cam caps 52 are coupled with the upper side 24 of the cam carrier 20, each on opposing sides of the camshaft 18, such that the semi-circular bearing surfaces 54 arch over the respective camshaft 18 and provide upper support to the camshaft 18. In the illustrated embodiment, the plurality of cam caps 52 are separately formed from the cam carrier 20 and each of the plurality of cam caps 52 are fastened to the upper side 24 of the cam carrier 20 with fasteners 56 that engage the cam carrier 20 on opposing sides of each camshaft 18. As shown, each camshaft 18 includes four cam caps 52 that secure the camshaft 18 against the bearing surfaces 26 of the cam carrier 20. As such, end caps 58 of the plurality of cam caps 52 are attached at a first end 60 of the cam carrier 20 to allow an exterior disk 62 on the camshaft 18 to rotate outside the cam carrier 20. The cam caps 52 as shown include a bearing insert 64 that defines the semi-circular bearing surface 54 with arm portions 66 extending outward from ends of the semi-circular bearing surfaces 54 to abut the cam carrier 20 around the fasteners 56 used to attach the cam caps 52. The bearing inserts 64 may be a metal material, such as a steel alloy, an aluminum alloy, and other conceivable metals or combinations or layers thereof, and may include a layer of babbitt material or other surface plating or coating to improve and further define the semi-circular bearing surface 54. An upper piece 68 of the cam caps 52 attaches over the bearing inserts 64 and defines mounting bosses on opposing sides of the camshaft 18 with fastener apertures 70 extending vertically therein to receive the fasteners 56 that secure the cam caps 52 to the cam carrier 20. It is conceivable that the upper piece 68 of the cam caps 52 may include a polymer material and/or may be a uniform material with the bearing inserts 64, such as a metal alloy or composite material.

As also shown in FIG. 3, a fuel pump pedestal 72 is coupled with the upper side 24 of the cam carrier 20 proximate a second end 74 thereof over one of the camshafts 18. The fuel pump pedestal 72 is configured for supporting a fuel pump on a top surface 76 thereof. The fuel pump pedestal 72 in the illustrated embodiment is formed separately from the cam carrier 20 and is fastened to the upper side 24 of the cam carrier 20 with threaded fasteners. The top surface 76 of the fuel pump pedestal 72 is generally planar and spans over the vertically protruding fuel pump pedestal 72 with a hole 78 extending downward in a central area and two smaller attachment apertures 80 on opposing sides of the hole 78. The attachment apertures 80 are configured to receive fasteners for securing a fuel pump to the planar top surface 76 of the fuel pump pedestal 72. Additional embodiments may have the fuel pump pedestal 72 alternatively configured or positioned on the cam carrier 20 and may have the fuel pump pedestal 72 integrally formed with the cam carrier 20 or portions thereof.

Figure 4:
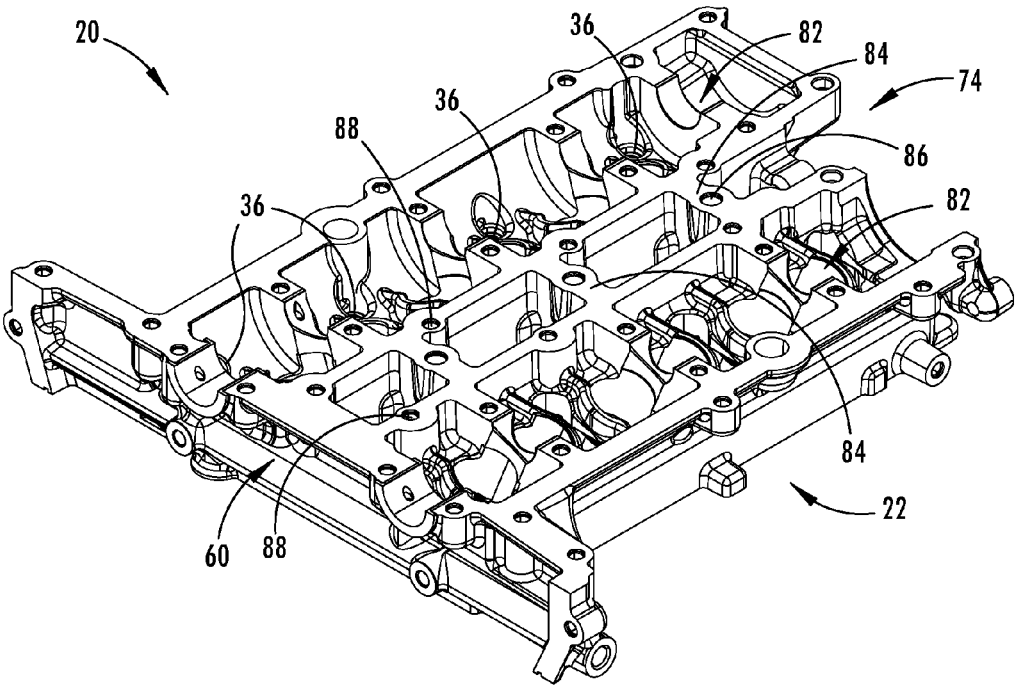
FIG. 4 is a top perspective view of the cam carrier taken from one end.
Figure 5:
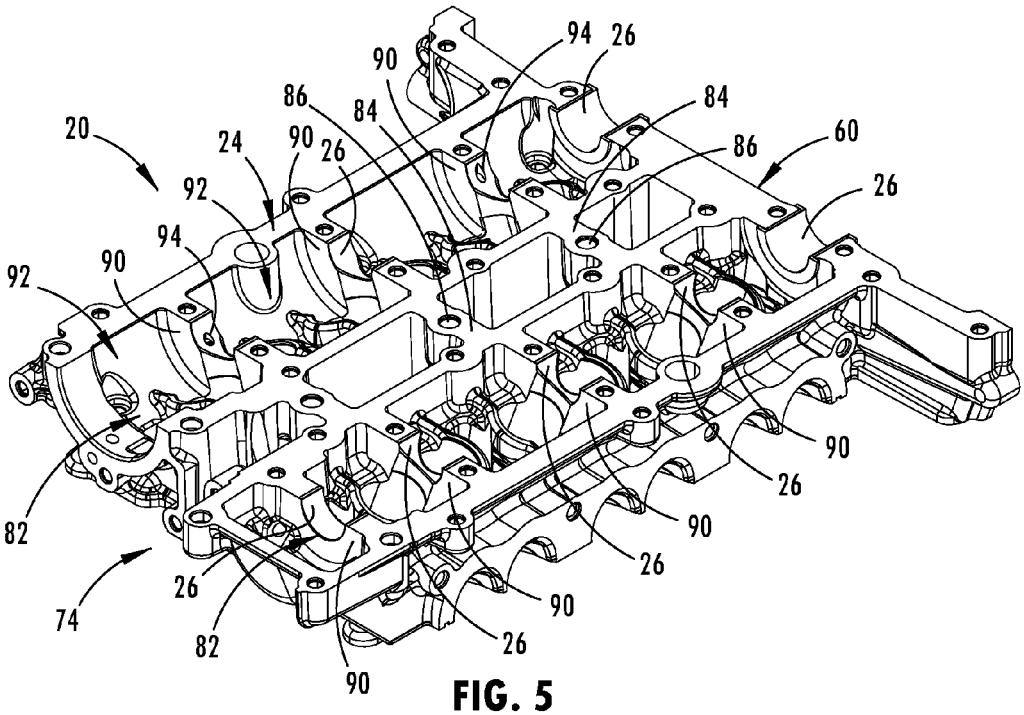
FIG. 5 is a top perspective view of the cam carrier taken from an opposite end from that shown in FIG. 4.

With reference to FIGS. 4-5, the cam carrier 20 is illustrated without the camshafts 18 to show how the cam carrier 20 is substantially divided into two separate longitudinal cam housings 82 for each camshaft 18. The cam housings 82 extend in parallel relationship to each other and in alignment with a rotational axis of the associated camshaft 18. The longitudinal cam housings 82 are interconnected with reinforcement members 84 that are formed integrally with the overall cam carrier 20. The reinforcement members 84, in the illustrated embodiment, extend orthogonally between the longitudinal cam housings 82 and each include mounting apertures 86 to receive fasteners for attaching at least one fuel rail that extends in general parallel alignment with the camshafts 18, as generally understood in the art. Interior edges of the longitudinal cam housings 82 proximate the reinforcement members 84 include cover mounting apertures 88 for mounting fasteners that secure a cam cover over the upper surface 24 of the cam carrier 20 to enclose the camshafts 18. It is contemplated that additional embodiments may include a single camshaft or camshafts spaced apart far enough to necessitate separate cam carriers that have a single longitudinal cam housing. Further, it is conceivable that alternative embodiments may have more or alternatively arranged camshafts to require additional longitudinal cam housings or a differently configured cam carrier.

Figure 6:
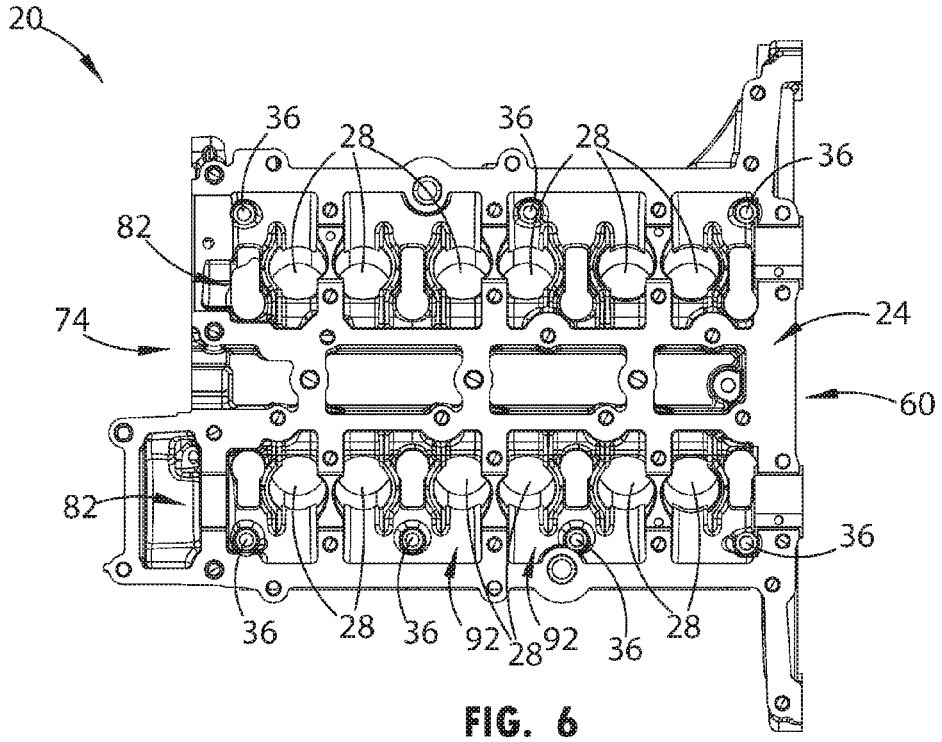
FIG. 6 is a top plan view of the cam carrier.

As further illustrated in FIGS. 4-6, each of the longitudinal cam housings 82 includes a series of vertical walls 90 that separate and define a series of cavities 92 on the upper side 24 of the cam carrier 20. The series of cavities 92 are sufficiently sized to each include an area that surrounds the cam lobes 16 of the camshaft 18 and permits rotation therein. To effectuate rotation, the series of vertical walls 90 have the lower semi-circular bearing surfaces 26 formed therein and aligned for supporting the associated camshaft 18. The illustrated semi-circular bearing surfaces 26 formed in the cam carrier 20 have a narrowed thickness in the vertical walls 90 proximate the lowest point of the bearing surface 26, which gradually narrows toward the lowest point. Between the vertical walls 90, within the cavities 92, the series of apertures 28 extend between the upper and lower sides 24, 22 in alignment with the camshaft 18 for the lobes 16 of the camshaft 18 to interface with the valves 14 on the cylinder head 12. Accordingly, the series of apertures 28 are arranged in linear alignment with the bearing surfaces 26 for the camshaft 18 to be positioned over the series of cavities 92 and interface with the valves 14 extending through the series of apertures 28.

Still referring to FIGS. 4-6, the vertical walls 90 are shown to include outlet apertures 94 for oil feed channels formed integrally within the cam carrier 20, such that lubrication may traverse the oil feed channels and be dispensed from the outlet apertures 94 to a circumference of the bearing surfaces 26, thereby lubricating the camshaft 18 for rotation on the bearing surfaces 26. The oil feed channels, as shown, enter a bottom portion of the cam bearing surfaces 26 at a location to form a sufficient thickness of lubricant to prevent the camshaft 14 from contacting the carbon fiber composite of the cam carrier 20 along the bearing surface 26. Also, in this embodiment, the oil feed channels align with and connect to corresponding channels in the cylinder head 12 (FIG. 2) to receive the flow of lubricating oil. However, it is contemplated that in additional embodiments, the oil feed channels may extend from alternative surfaces or locations on the cam carrier 20 and the oil feed channels may enter the cam bearings at different locations.

Figure 7:
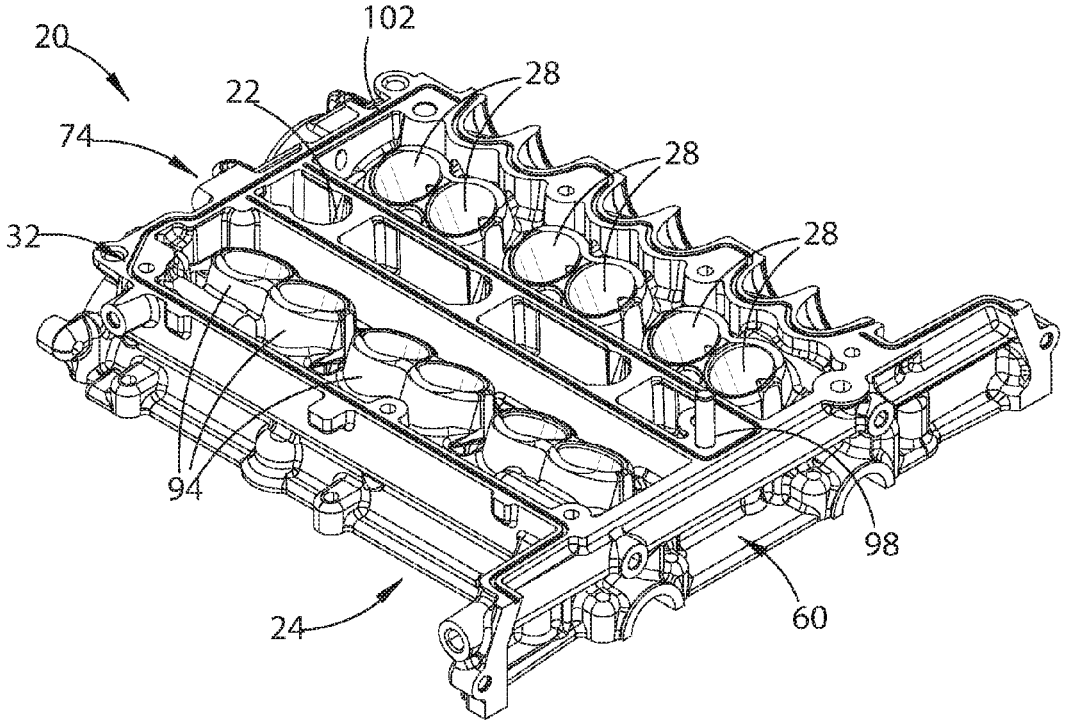
FIG. 7 is a bottom perspective view of the cam carrier.

As illustrated in FIGS. 6-7, the series of apertures 28 are cylindrically shaped and angled vertically inward toward the opposing cam housing 82 for the corresponding valves 14 (FIG. 10) to engage a piston cylinder centrally between the longitudinal cam housings 82. The lower side 22 of the cam carrier 20 includes tubular projections 96 that each surrounds one of the apertures 28 of the series of apertures 28. The tubular projections 96 are arranged in interconnected pairs that are each designated for a single piston cylinder. The lower side 22 of the cam carrier 20, as illustrated, also includes a locating member 98 protruding downward for engaging a corresponding locating aperture 100 on the cylinder head 12 (FIG. 2), for aligning the cam carrier 20 on the cylinder head 12 and thereby aligning the camshaft 18 with the valves 14. It is contemplated that the lower side 22 of the cam carrier 20 in additional embodiments may include a locating aperture that engages a corresponding locating member on the cylinder head 12, and is also conceivable that various arrangements and combinations of the locating members and apertures may be incorporated between the cam carrier 20 and the cylinder head 12 to provide proper alignment.

As further illustrated in FIGS. 6-7, the lower side 22 of the cam carrier 20 may include a gasket channel 102 substantially surrounding the series of apertures 28 on each longitudinal cam housing 82 for a gasket 34 (FIG. 9) to attach therein. The channel 102 is formed on the peripheral edge 32 of the lower side 22 of the cam carrier 20 for consistently abutting the upper portion of the cylinder head 12 around the valves 14. The gasket 34 may be provided in the channel 102 to provide sealed engagement of the cam carrier 20 to the cylinder head 12, preventing leakage of fluids and gases there between.

Figure 8:
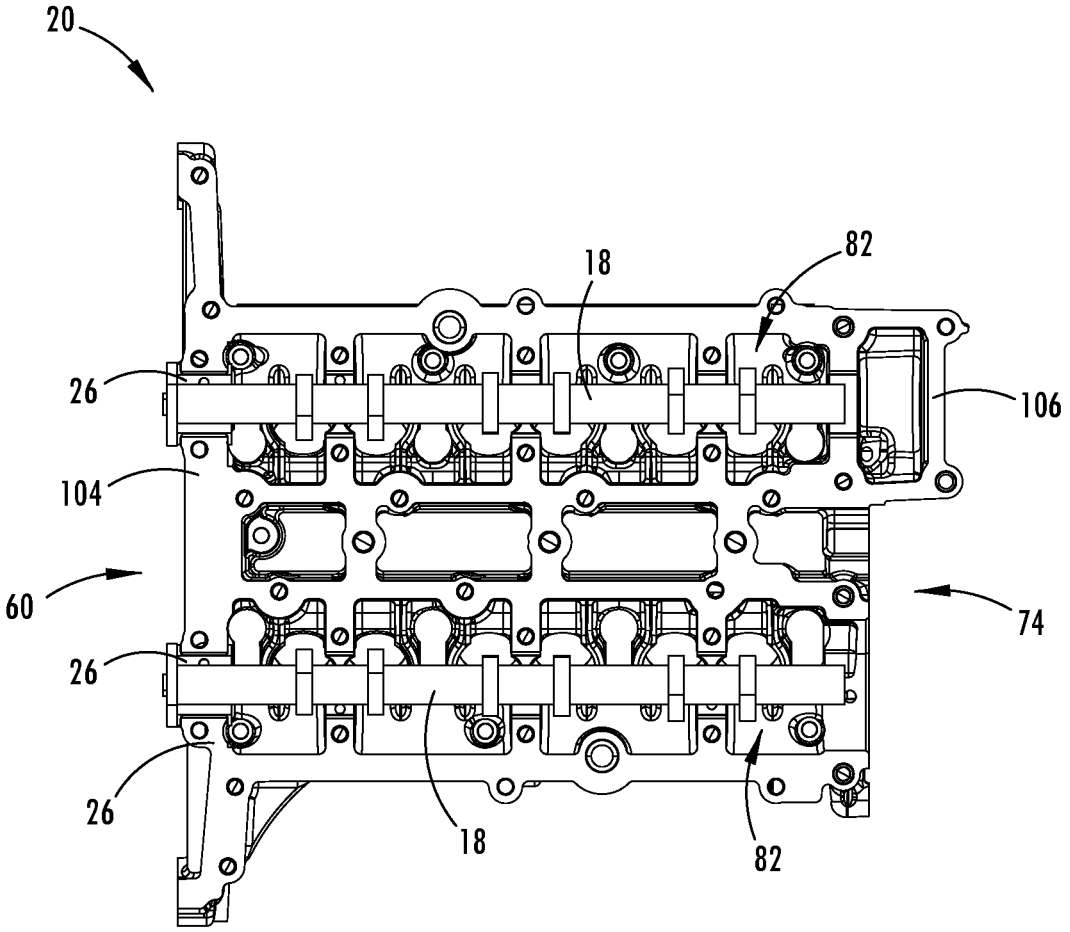
FIG. 8 is a top plan view of the cam carrier having camshafts and cam caps assembled therewith.
Figure 9:
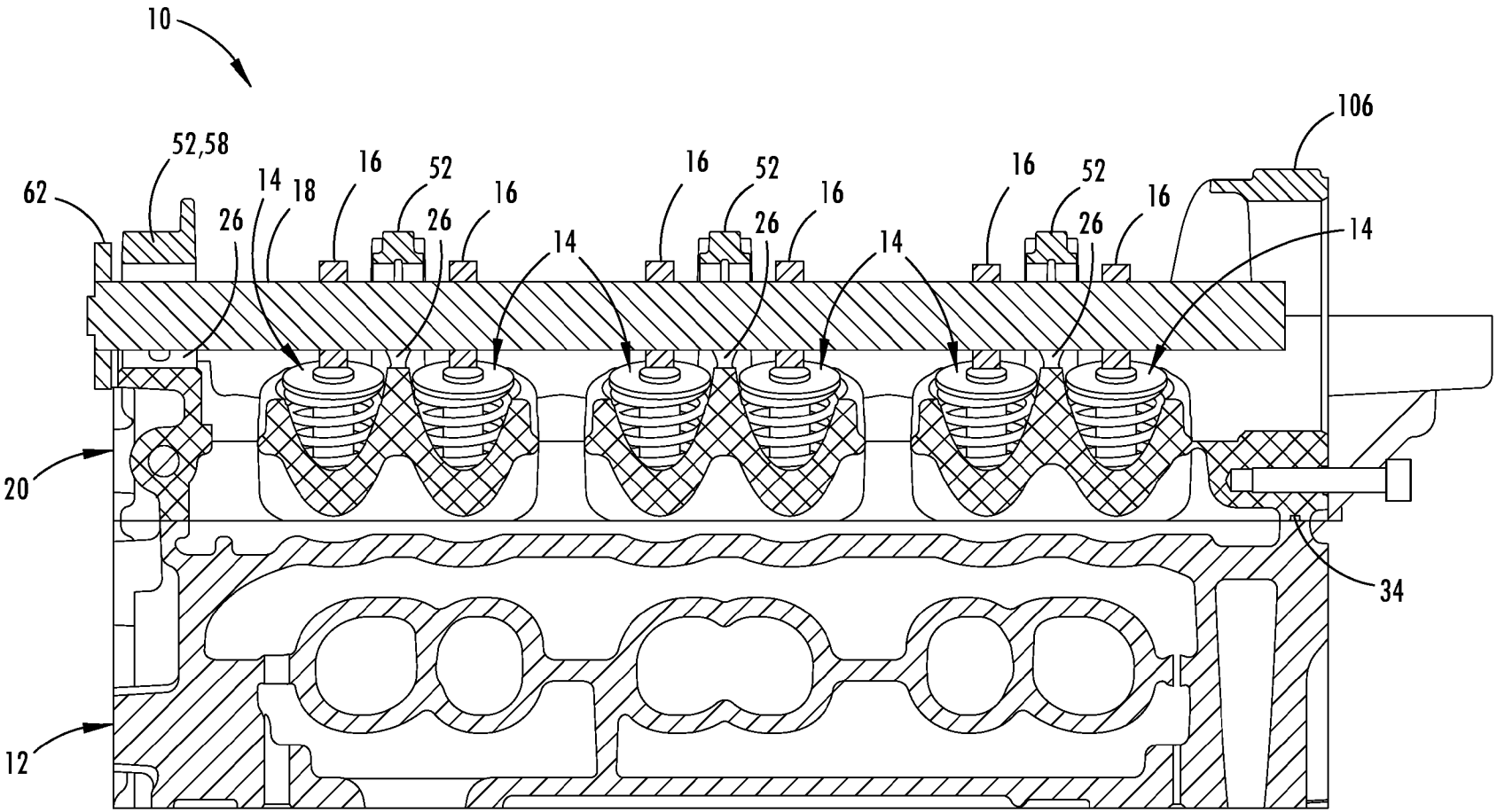
FIG. 9 is a cross-sectional view of the cam carrier, camshaft, and cam caps, taken at line IX-IX of FIG. 8.

Referring to FIGS. 8-9, a first end wall 104 of the cam carrier 20, proximate the first end 60 of each of the longitudinal cam housings 82 includes one of the semi-circular bearing surfaces 26 for the respective camshaft 18 to protrude through the first end wall 104 out of the cam carrier 20 for engaging a timing mechanism, such as a belt or chain, as generally understood by one of ordinary skill. However, an opposing second end wall 106 of the cam carrier 20, proximate the second end 74 of the longitudinal cam housings 82, does not include an aperture for the camshaft to exit the cam carrier 20, thereby substantially enclosing the corresponding end portions of the camshafts 18. As also shown in the illustrated embodiment, the cam carrier 20 is attached in directly abutting contact with the cylinder head 12 (FIG. 2) and the camshaft 18 is supported in direct contact with the bearing surfaces 26 of the cam carrier 20, providing only the material of the cam carrier 20 there between.

Figure 10:
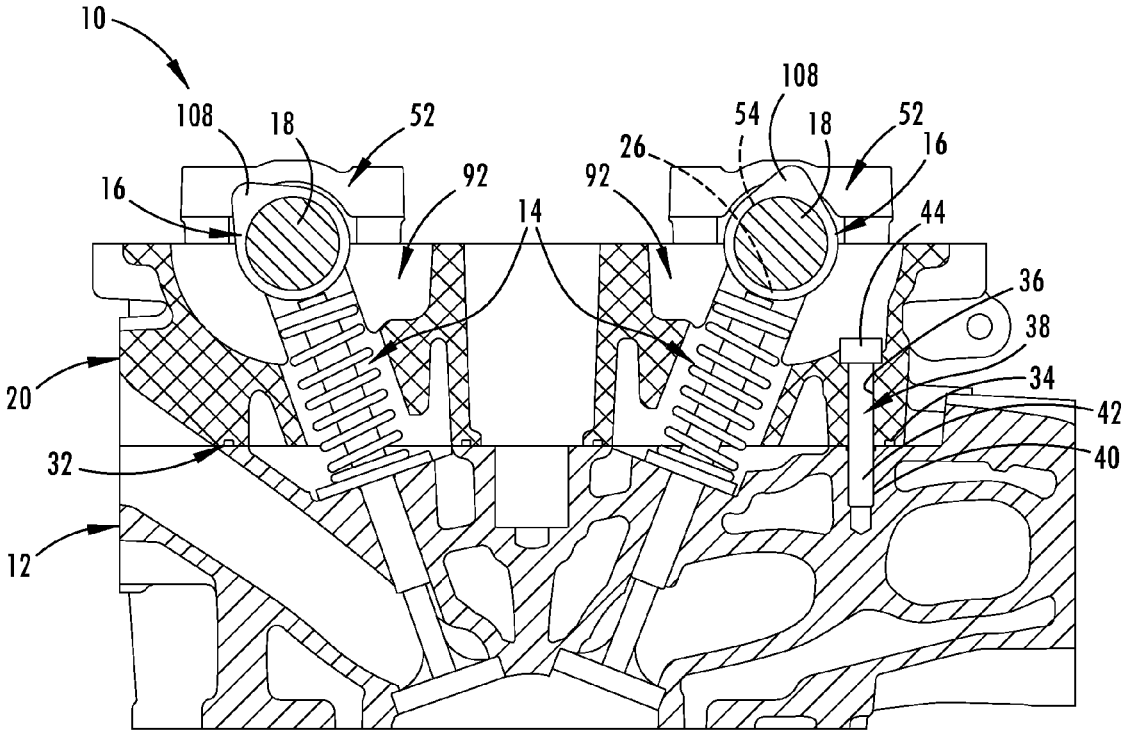
FIG. 10 is a cross-sectional view of the cam carrier, camshaft, and cam caps, taken at line X-X of FIG. 8, illustrating a bearing for the camshaft and the camshaft interfacing with valves on the cylinder head.

As depicted in FIG. 10, the upper semi-circular bearing surfaces 54 of the plurality of cam caps 52 together with the semi-circular bearing surfaces 26 on the upper side 24 of the cam carrier 20 define cam bearings that surround the circumference of the camshaft 18. The illustrated bearings have two equal halves of the total circumference of the bearing defined by the lower semi-circular bearing surface 26 on the cam carrier 20 and the upper semi-circular bearing surface 54 on the cam caps 52. Within the cavities 92 on the upper side 24 of the cam carrier 20, the head mounting holes 36 extend downward to align with the fastening holes 40 in the cylinder head 12 for the head portion 44 of the fastener 38 abuts the upper side 24 of the cam carrier 20 and a shank portion 42 of the fastener 38 to threadably engage the cylinder head 12 and thereby compresses the cam carrier 20 there between and form a fluid seal along the peripheral edge 32 proximate the gasket 34 between the cylinder head 12 and the cam carrier 20. The lobes 16 of the camshaft 18 are also illustrated to include a nose 108 that abuts the distal end surfaces 50 of one of the valves 14 to actuate and open the valve 14, displacing the valve stem downward and moving the plunger of the valve 14 away from the valve seat on a lower portion of the cylinder head 12, as generally understood in the art.

With respect to the carbon fiber composite material used to integrally form the cam carrier 20 as a single unit, it is contemplated that various methods of carbon fiber construction may be used, including injection molding a polymer resin with chopped carbon fiber particles. It is also conceivable that portions or the entire cam carrier 20 may be made with different carbon fiber constructions, such as wound filament or layered sheets. The carbon fiber composite may also include additional reinforcing fibers, such as aramid or glass fibers, and may have various compositions of resin or graphite materials to form the composite structure. Despite the construction, the illustrated embodiment of the cam carrier 20 has both upper and lower sides 24, 20 with surfaces defined by carbon fiber composite material. Further, the illustrated embodiment of the cam carrier 20 has the semi-circular bearing surfaces 26 defined by carbon fiber composite material. It is contemplated that the bearing surfaces 26 may have strands of carbon fiber wound around in the direction of the circumference of camshaft 18 to provide the bearing surface 26 with fewer surface irregularities. Furthermore, it is contemplated that the bearing surfaces 26 may have coatings over the carbon fiber composite to also provide the bearing surfaces 26 with fewer surface irregularities. With respect to the material used to form the cylinder head 12, the illustrated embodiment of the cylinder head 12 is comprised of an aluminum alloy. However, it is contemplated that additional or alternative alloys or metals, such as magnesium, may be used to form the cylinder head 12 or individual portions thereof.

Figure 11:
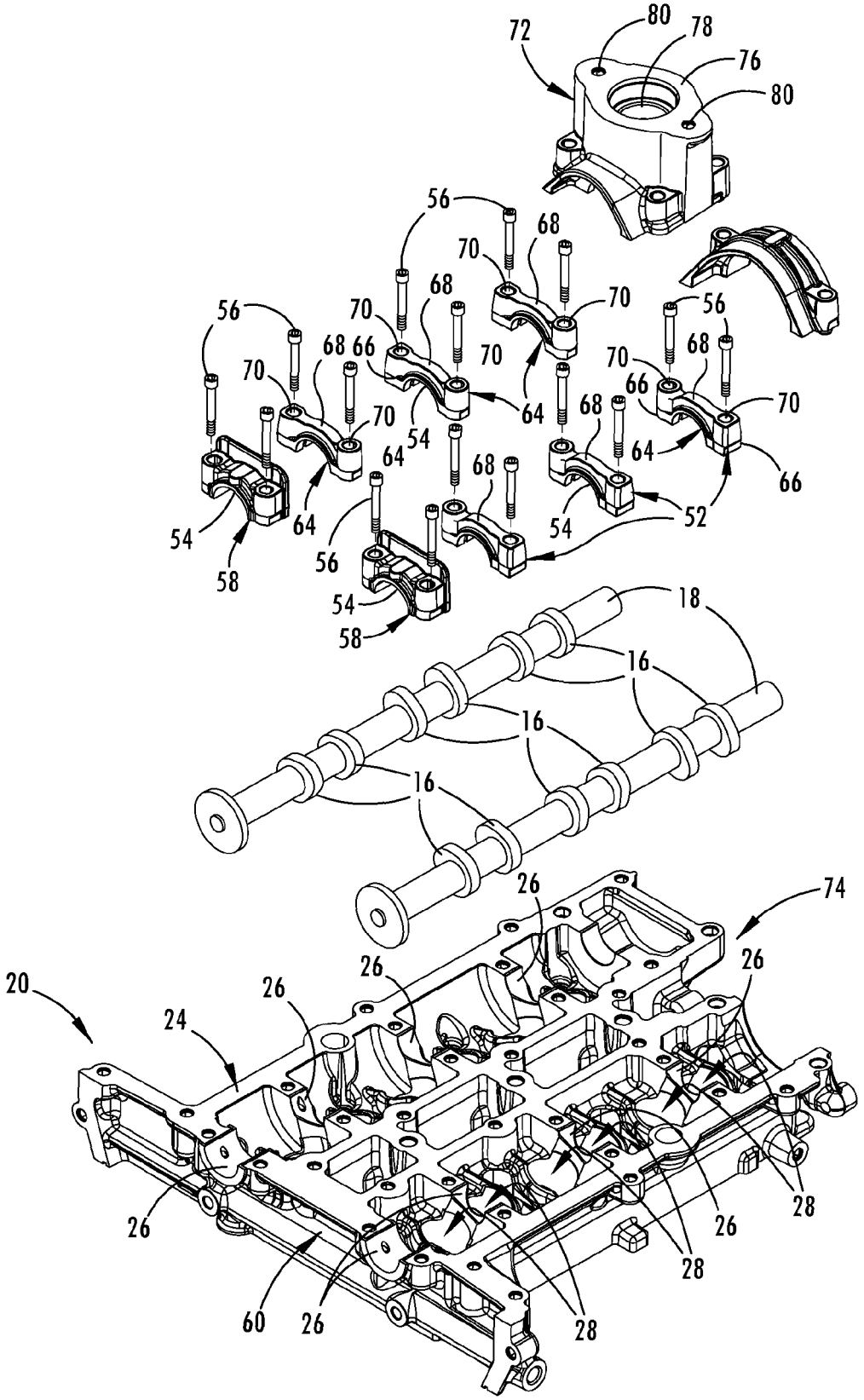
FIG. 11 is an exploded top perspective view of the cam carrier assembly, illustrating the assembly method for the associated camshafts.

Referring now to FIG. 11, the method of assembling the camshafts 18 to the cam carrier 20 is generally shown, whereby the camshafts 18 and lobes 16 are pre-assembled or otherwise formed. After providing any surface lubrication or coatings on the camshaft 18 and/or the bearing surfaces 26, the camshafts 18 are placed on the cam carrier 20 along the bearing surfaces 26 on the upper side 24. The length-wise position of the camshaft 18 is then adjusted to align the lobes 16 with the apertures 28 in the cam carrier 20 and the associated valves 14 (FIG. 10) that may be protruding therein from the cylinder head 12. Upon aligning the lobes 16, the cam caps 52 are placed over the camshaft 18 at multiple positions along the length of the camshafts 18. The fasteners 56 for the cam caps 52 are then driven through the cam caps 52 and into the cam carrier 20 for securing the camshafts 18 to the cam carrier 20 and preventing upward displacement of the camshaft 18 during operation of the engine. Further, either before or after installation of the cam caps 52, the fuel pump pedestal 72 is attached to the second end 74 of the cam carrier 20 with fasteners similar to the cam caps 52.

Figure 12:
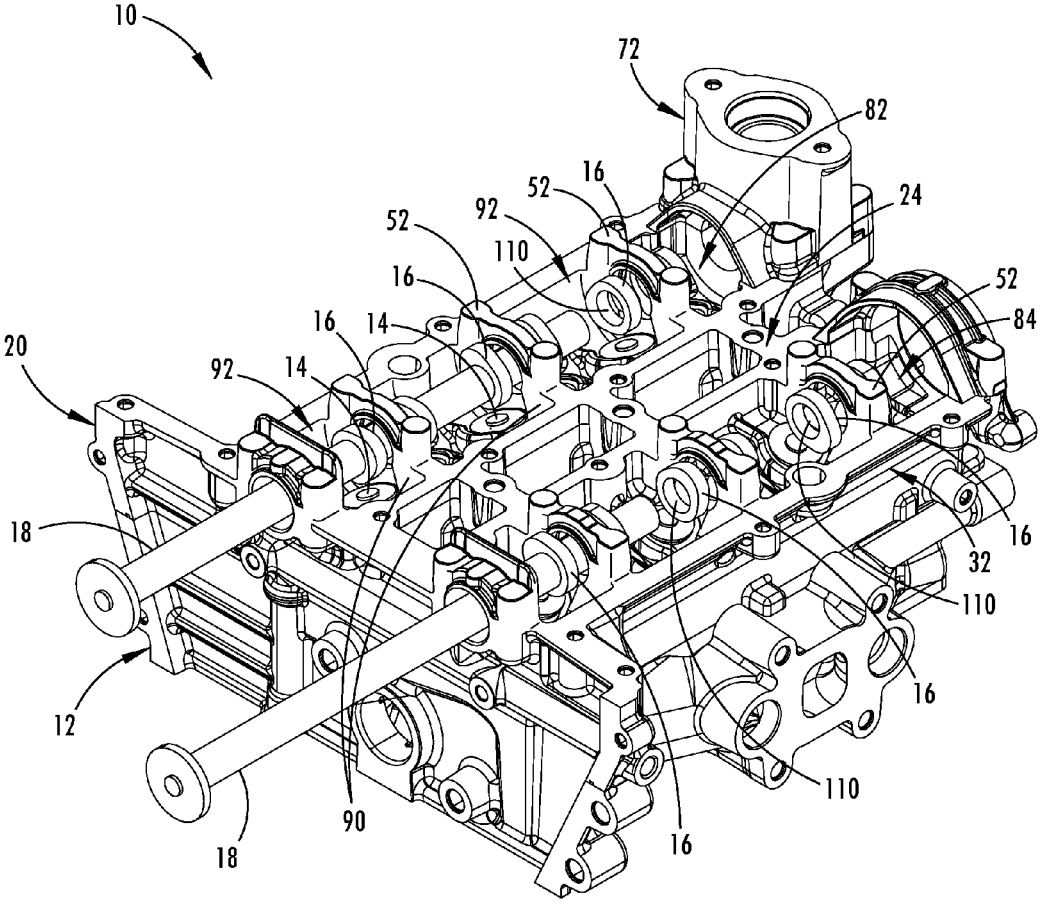
FIG. 12 is an exploded top perspective view of an additional embodiment of the cam carrier assembly, illustrating the assembly method for the associated camshafts.

An additional embodiment of the cam carrier 20 is illustrated in FIG. 12, along with the associated method of assembling the camshafts 18 to such cam carrier 20. In this embodiment of the cam carrier 20, each of the cam caps 52 are formed integrally with the cam carrier 20 and thereby protrude upward from the second side 24, such that the opposing bearing surfaces 54 of the cam caps 52 are an integral surface with the lower semi-circular bearing surfaces 26 of the cam carrier 20, together defining a circular bearing that operably engages the camshaft 18. According to such an embodiment, prior to mounting the cam carrier 20 on the cylinder head 12, the cam carrier 20 may be assembled with a camshaft 18 and a plurality of cam lobes 16 to define a valve cover module, which may reduce complexity and assembly steps at the stage of engine construction. To do so, the cam lobes 16 are aligned with the series of cavities 92 on the upper side 24 of the cam carrier 20 to position six cam lobes 16, one directly adjacent to opposing sides of the vertical walls 90, in the rows of cavities 92 along the longitudinal earn housings 82. The cam lobes 16 are each positioned vertically within the cavities 92, such as with a support frame, so a mating surface 110 of each cam lobe 16, defined by an interior surface of lobe apertures formed therein, are each aligned with the center of the cam bearings. When the lobe apertures are aligned with the cam bearings and the cam lobes 16 are radially positioned for appropriate valve timing, the camshafts 18 are inserted sequentially through the cam bearings to couple with each of the cam lobes 16. The mating surfaces 110 of the lobe apertures may be attached to the camshaft 18 with various techniques, including thermal expansion, welding, and other conceivable techniques generally understood by one having ordinary skill in the art. The cam lobes 16 in the illustrated embodiment have a greater diameter than the cam bearings, such that the cam lobes 16 cannot be attached to the camshaft 18 prior to inserting the camshaft 18 through the cam bearings in this embodiment.

With further reference to the additional embodiment illustrated in FIG. 12, upon inserting the camshafts 18 to a position with the end portions exposed and all the cam lobes 16 attached thereto, a cam cover may be secured over the cam carrier to define a valve cover module that may then be mounted to the cylinder head 12. To do so, the peripheral edge 32 of the cam carrier 20 may be attached to the cylinder head 12 around the engine valves 14 thereon with a gasket 34 that may be disposed between the cam carrier 20 and the cylinder head 12 to provide a fluid seal. Prior to or after attaching the cam carrier 20 to the cylinder head 12, a fuel pump may be attached to the fuel pump pedestal 72. In this embodiment, the fuel pump pedestal 72 is also integrally formed with the carbon fiber composite material of the cam carrier 20 to form a single piece with the cam carrier 20 and the cam caps 52.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A cam carrier assembly, comprising:

a camshaft having lobes;

a cam carrier made entirely of carbon fiber composite and having a lower side with an integrally formed locating member protruding downward that engages with, and laterally aligns, a cylinder head with the cam carrier prior to fixedly coupling the cam carrier to the cylinder head, an upper side with semi-circular bearing surfaces supporting the camshaft, wherein at least a portion of the semi-circular bearing surfaces include strands of carbon fiber wound around in the direction of the circumference of the camshaft, and a linear series of apertures extending between the upper and lower sides in alignment with the camshaft for the lobes to interface with valves on the cylinder head.

2. The cam carrier assembly of claim 1, wherein the carbon fiber composite is configured to provide insulation between the cylinder head and the camshaft.

3. The cam carrier assembly of claim 1, wherein the carbon fiber composite includes a polymer resin and a chopped fiber configured for injection molding the cam carrier.

4. The cam carrier assembly of claim 1, further comprising:

a plurality of cam caps coupled with the upper side of the cam carrier, each on opposing sides of the camshaft and having an upper semi-circular bearing surface for directly engaging the camshaft.

5. The cam carrier assembly of claim 4, wherein the plurality of cam caps are separately formed from the cam carrier and each of the plurality of cam caps are fastened to the upper side of the cam carrier with fasteners engaging the cam carrier on opposing sides of the camshaft.

6. The cam carrier assembly of claim 4, wherein the upper semi-circular bearing surfaces of the plurality of cam caps together with the semi-circular bearing surfaces on the upper side of the cam carrier define bearings that surround the camshaft.

7. The cam carrier assembly of claim 1, further comprising:

a fuel pump pedestal coupled with the upper side of the cam carrier for supporting a fuel pump.

8. A cam carrier, comprising:

a carbon fiber composite comprising:

a first side having a locating member for engaging, and laterally aligning the first side with, a cylinder head prior to fixedly coupling said cam carrier to the cylinder head; and an opposing second side with bearing surfaces for supporting a camshaft, wherein the bearing surfaces include strands of carbon fiber wound in the direction of the circumference of the bearing surfaces.

9. The cam carrier of claim 8, wherein the carbon fiber composite is configured to provide insulation between the cylinder head and the camshaft.

10. The cam carrier of claim 8, wherein the carbon fiber composite includes a polymer resin and a chopped fiber combined to have sufficient rigidity to support forces on the camshaft.

11. The cam carrier of claim 8, further comprising:

a plurality of cam caps, each protruding from the second side to surround the camshaft and define an opposing bearing surface that operably engages the camshaft.

12. The cam carrier of claim 11, wherein the plurality of cam caps are fastened to the second side of the cam carrier with fasteners engaging the cam carrier on opposing sides of the camshaft.

13. The cam carrier of claim 8, wherein the single piece of carbon fiber composite includes oil feed channels formed integrally therein and extending to a circumference of the bearing surfaces for providing lubrication to the camshaft.

14. The cam carrier of claim 13, wherein a fuel pump pedestal is formed separately from the cam carrier and fastened to an upper side of the cam carrier with threaded fasteners.

15. A cam carrier assembly, comprising:

a cylinder head having valves;

a camshaft having lobes;

a cam carrier having a first side with a locating member protruding downward that couples with a locating aperture on the cylinder head to laterally align the cam carrier and cylinder head prior to fixedly coupling the cam carrier to the cylinder head, wherein the first side is further coupled with the cylinder head engaging around the valves; and a second side with bearing surfaces supporting the camshaft, and a series of apertures extending between the first and second sides for the lobes to interface with the valves, the cam carrier made of layered sheets of carbon fiber composite insulating the camshaft from the cylinder head.

16. The cam carrier assembly of claim 15, further comprising:

a plurality of cam caps coupled with the second side of the cam carrier, each having a semi-circular bearing surface for directly engaging the camshaft.

17. The cam carrier assembly of claim 15, further comprising: a gasket attached around a peripheral edge of the first side and configured to sealably engage the cam carrier to the cylinder head.

* * * * *